US005536431A

United States Patent [19]

Carduck et al.

[11] Patent Number: 5,536,431

[45] Date of Patent: Jul. 16, 1996

[54] PROCESS FOR THE PRODUCTION OF FREE-FLOWING DETERGENT GRANULES AND/OR PARTIAL GRANULES

[75] Inventors: Franz-Josef Carduck, Haan; Paul Schulz, Wuppertal; Rainer Eskuchen, Langenfeld, all of Germany

[73] Assignee: Henkel Kommanditgesellschaft auf Aktien, Duesseldorf, Germany

[21] Appl. No.: 307,728

[22] PCT Filed: Mar. 15, 1993

[86] PCT No.: PCT/EP93/00593

§ 371 Date: Sep. 23, 1994

§ 102(e) Date: Sep. 23, 1994

[87] PCT Pub. No.: WO93/19155

PCT Pub. Date: Sep. 30, 1993

[30] Foreign Application Priority Data

Mar. 23, 1992 [DE] Germany ..... 42 09 339.2

[51] Int. Cl.[6] ..... C11D 11/00

[52] U.S. Cl. ..... 510/444; 159/4.4; 159/48.1; 510/457; 510/470

[58] Field of Search ..... 252/174.17, 89.1, 252/174, 174.21, 530, 549, DIG. 1; 159/4.4, 48.1

[56] References Cited

U.S. PATENT DOCUMENTS 3,703,772 11/1972 McHugh et al. ..... 34/9

4,536,319 8/1985 Payne ..... 252/174.17

FOREIGN PATENT DOCUMENTS 0301298 7/1988 European Pat. Off. .

0340966 11/1989 European Pat. Off. .

0411477 2/1991 European Pat. Off. .

8702053 4/1987 WIPO .

9201036 1/1992 WIPO .

*Primary Examiner*—Paul Lieberman

*Assistant Examiner*—Lorna M. Douyon

*Attorney, Agent, or Firm*—Ernest G. Szoke; Wayne C. Jaeschke; Real J. Grandmaison

[57] ABSTRACT

A process for the production of free-flowing detergent granules or partial granules comprising the steps of:

(a) providing an interiorly baffled, rotatable drying apparatus capable of rotating at high speeds;

(b) introducing water-containing alkyl or alkenyl oligoglycoside pastes into the rotatable, drying apparatus;

(c) introducing into the drying apparatus detergent components selected from the group consisting of anionic surfactants, nonionic surfactants, detergent builders, and mixtures thereof; and (d) simultaneously drying and granulating the water-containing alkyl or alkenyl oligolycoside pastes and detergent components.

13 Claims, No Drawings

PROCESS FOR THE PRODUCTION OF FREE-FLOWING DETERGENT GRANULES AND/OR PARTIAL GRANULES

BACKGROUND OF THE INVENTION

1. Field of the Invention

This invention relates to a process for the production of free-flowing detergent granules and/or partial granules, in which water-containing alkyl and/or alkenyl oligoglycoside pastes are dried and at the same time granulated in a turbo-dryer with rotating fittings in the presence of surfactants and/or other detergent ingredients.

2. Prior Art

Powder-form detergents are normally produced by spray drying. To this end, a water-containing slurry of the ingredients, for example surfactants, builders and fillers, is pumped into the spray drying tower and sprayed through nozzles arranged at the head of the tower. Ascending air with a temperature of 250° to 300° C. dries the slurry and evaporates the adhering water so that a substantially water-free granulated or powder-form product is obtained at the tower exit. Particulars of this process can be found, for example, in ROEMPP Chemie Lexikon, Thieme Verlag, Stuttgart, Vol. V, 1992 under the heading "spray drying".

However, this process is not suitable for the production of powders containing alkyl and/or alkenyl oligoglycosides as their surfactant component (either individually or in admixture with other surfactants), because the high temperatures required in the spray drying tower can lead to partial decomposition of the glucoside. The outcome of this are granules or partial granules with poor color quality and unsatisfactory performance properties. In the present context, partial granules are understood to be intermediate products from which detergents can be produced by mixing in the presence of suitable active substances.

Accordingly, the problem addressed by the present invention was to provide a new process for the production of detergent granules and/or partial granules which would be free from the disadvantages mentioned above.

DESCRIPTION OF THE INVENTION

The present invention relates to a process for the production of free-flowing detergent granules and/or partial granules which is characterized in that water-containing alkyl and/or alkenyl oligoglycoside pastes are dried and at the same time granulated in a turbo-dryer with rotating fittings in the presence of anionic and/or nonionic surfactants and/or typical detergent ingredients.

It has surprisingly been found that light-colored, substantially water-free detergent granules and/or partial granules can be obtained by carrying out the drying and granulation of alkyl and/or alkenyl oligoglycoside pastes in a turbo-dryer in the presence of surfactants and/or other typical ingredients. The products are stable in storage and, in addition, are distinguished by a narrow particle size distribution.

Alkyl and/or alkenyl oligoglycosides suitable as starting materials for the process according to the invention correspond to formula (I):

$$R^1O—(R^2O)_x—[G]_p \quad (I)$$

in which $R^1$ is an aliphatic hydrocarbon radical containing 8 to 22 carbon atoms and 0, 1, 2 or 3 double bonds, $R^2$ is an alkylene group containing 2 to 4 carbon atoms, x=0 or a number of 1 to 30,

[G] is a sugar unit containing 5 to 6 carbon atoms and p is a number of 1 to 10.

Preferred alkyl and/or alkenyl oligoglycosides are those derived from aldoses or ketoses and—by virtue of its ready availability—preferably from glucose. Accordingly, the preferred alkyl oligoglycosides are the alkyl oligoglucosides.

The index p in general formula (I) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl and/or alkenyl oligoglycoside is an analytically determined calculated quantity which is generally a broken number. Alkyl oligoglycosides with an average degree of oligomerization p of 1.1 to 3.0 are preferred, alkyl and/or alkenyl oligoglycosides with a degree of oligomerization of less than 1.7 and, more particularly, between 1.2 and 1.4 being particularly preferred.

The substituent $R^1$ may be derived from saturated and/or unsaturated primary alcohols containing 8 to 22 and preferably 8 to 10 or 12 to 18 carbon atoms. Typical examples are capric alcohol, 2-ethylhexanol, caprylic alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, arachyl alcohol, gadoleyl alcohol, behenyl alcohol and erucyl alcohol and also technical cuts which may contain these alcohols in various quantities. Alkyl and/or alkenyl oligoglucosides based on $C_{8/10}$ and $C_{12/14}$ coconut oil fatty alcohol are preferred.

In addition, the alkyl and/or alkenyl oligoglycosides may be present in the form of their adducts with 1 to 30 moles of ethylene, propylene and/or butylene oxide.

Alkyl and/or alkenyl oligoglycosides are known substances which may be obtained by the relevant methods of preparative organic chemistry. One process for their production is based, for example, on the acid-catalyzed acetalization of glucose with fatty alcohols. European patent application EP-A1-0 301 298 is cited as representative of the extensive literature available on the subject.

The alkyl and/or alkenyl oligoglycosides are used in the form of water-containing pastes which may have a water content of 20 to 80% by weight and preferably 30 to 50% by weight, based on the paste.

To produce granules and partial granules, it is of advantage to process other ingredients, for example anionic or nonionic surfactants, builders, fillers, etc., together with the alkyl and/or alkenyl oligoglycoside pastes to form dry free-flowing granules.

The anionic surfactants may be selected, for example, from the group consisting of soaps, alkyl benzenesulfonates, olefin sulfonates, alkane sulfonates, alkylether sulfonates, alpha-sulfofatty acids, internal sulfofatty acids, alpha-ester sulfonates, glycerol ether sulfonates, alkyl sulfates, alkylether sulfates with a conventional or narrow homolog distribution, glycerol ether sulfates, monoglyceride (ether) sulfates, hydroxy mixed ether sulfates, alkyl oligoglucoside sulfates, isethionates, taurides, sarcosinates, ether carboxylic acids, sulfosuccinates, sulfotriglycerides and alkyl (ether) phosphates.

Suitable nonionic surfactants are, for example, substances selected from the group consisting of fatty alcohol polyglycol ethers with a conventional or narrow homolog distribution, alkylphenol polyglycol ethers, mixed ethers, amine oxides, sugar esters, sorbitan esters and polysorbates.

Detergents and ingredients are understood, for example, to be mixture components selected from the group consisting of alkali metal and alkaline earth metal phosphates and phosphonates, zeolites, nitrilotriacetic acid (NTA), ethylenediaminetetraacetic acid (EDTA), citric acid, polycarboxylic acids, alkali metal and alkaline earth metal carbonates, sulfates, silicates, borates and citrates, starch, sucrose, polydextrose, active oxygen carriers, bleach activators, optical brighteners and foam inhibitors.

The ratio of the individual components to one another is not critical providing measures are taken to ensure that the starting materials can be introduced into the turbo-mixer without difficulty, i.e. by means of standard pumps or the like. So far as the problem addressed by the present invention is concerned, preferred mixtures are those which, after drying and granulation, give detergent granules and/or partial granules containing from 2 to 90% by weight and preferably from 5 to 70% by weight, based on the granules, of alkyl and/or alkenyl oligoglycosides.

Turbo-dryers are cylindrical, preferably horizontal, dryers in which fittings rotating at high speed provide for fine distribution of the material to be dried. In one preferred embodiment, the fittings in question are, for example, blades, vanes or paddles which are mounted on a rotating shaft (peripheral speed 5 to 25 m/s, preferably 10 to 20 m/s). The actual drying process may take place at wall temperatures of 100° to 180° C. and at gas phase temperatures of 150° to 220° C., preferably in the presence of air or inert gases such as, for example, nitrogen or superheated steam, heat being transferred by convection or through the heated wall of the dryer. A gas phase temperature of 150° to 220° C. has proved to be optimal for the production of the detergent granules and/or partial granules according to the invention. The dry material may be removed, for example, by means of a cyclone and/or a tube filter.

Since the heated air or the heated inert gas is introduced into the dryer at the same time as the moist product to be dried, the water is instantaneously evaporated. By virtue of the high heat of evaporation of water, this results in a temperature-stabilizing effect so that the drying process may even take place at high temperatures without any danger of decomposition of temperature-labile products.

Accordingly, particular features of the turbo-dryers to be used in accordance with the invention are the short residence time, the narrow residence time spectrum and the high temperature stabilization which ensure gentle treatment of the material being dried, above all in regard to composition and color.

INDUSTRIAL APPLICATIONS

The detergent granules and/or partial granules obtainable by the process according to the invention have a residual water content of 0.1 to 5% by weight and an advantageously narrow particle size distribution. They are suitable for example for the production of detergent powders in which they may be present in concentrations of 10 to 100% by weight, based on the detergent.

The following Examples are intended to illustrate the invention without limiting it in any way.

EXAMPLES

The production of the detergent granules and/or partial granules was carried out in a horizontally arranged turbo-dryer (type ES 2050 manufactured by the Vomm Company of Milan, Italy) with a turbine diameter of 0.34 m and a turbine length of 2.4 m, in which a shaft fitted with blades or vanes rotated at high speed.

Example 1

Starting materials

A) 70 parts by weight of $C_{12/14}$ coconut oil alkyl oligoglucoside, 50% by weight water-containing paste (Plantaren® 600 APG, Henkel KGaA)

B) 15 parts by weight of zeolite A (Sasil®, Henkel KGaA) 10 parts by weight of sodium sulfate 5 parts by weight of starch.

Components A) and B) were continuously introduced at two points of the turbo-dryer situated axially one behind the other in the direction of flow.

At a rotational speed of 1000 r.p.m., the mixture was finely dispersed and, at the same time, dried in a hot, turbulent air stream. The drying temperature was 160° to 180° C. and was transferred on the one hand by convection and on the other hand through the heated wall of the dryer.

The dry granules were separated from the gas stream at the exit of the turbo-dryer by means of a cyclone and a tube filter. Light-colored, free-flowing granules with a narrow particle size distribution and a residual water content of 1.5% by weight were obtained.

Example 2

Example 1 was repeated using the following starting materials:

A) 55 parts by weight of $C_{8/10}$ coconut oil alkyl oligoglucoside, 50% by weight aqueous paste (Plantaren® 225 APG, Henkel KGaA) 15 parts by weight of $C_{12/14}$ coconut oil fatty alcohol 2EO sulfate sodium salt, 70% by weight aqueous paste (Texapon® N70, Henkel KGaA)

B) 12 parts by weight of zeolite A (Sasil®, Henkel KGaA) 10 parts by weight of sodium carbonate 8 parts by weight of starch.

Light-colored free-flowing granules with a narrow particle size distribution and a residual water content of 1.6% by weight were obtained.

We claim:

1. A process for the production of free-flowing detergent granules or partial granules consisting of the steps of sequentially:

(a) providing an interiorly baffled, rotatable turbo-dryer capable of rotating at high speeds;

(b) introducing into said turbo-dryer an aqueous paste selected from the group consisting of water-containing alkyl oligoglycoside, alkenyl oligoglycoside, and mixtures thereof;

(c) introducing into said turbo-dryer a detergent component selected from the group consisting of an anionic surfactant, a nonionic surfactant, a detergent builder, and mixtures thereof; and (d) simultaneously drying and granulating said paste and said detergent component at a dryer wall temperature of 100° C. to 180° C. and a gas phase temperature of from 160° to 220° C. to provide detergent granules or partial granules containing from 2 to 90% by weight of alkyl or alkenyl oligoglycoside, based on the weight of said granules.

2. The process of claim 1 wherein said water-containing alkyl or alkenyl oligoglycoside paste has the general formula I:

$$R^1O—(R^2O)_x—(G)_p \quad (I)$$

wherein $R^1$ is an aliphatic hydrocarbon radical having 8 to 22 carbon atoms and 0 to 3 double bonds; $R^2$ is an alkylene group containing 2 to 4 carbon atoms; x is an integer from 0 to 30; G is a sugar unit containing 5 to 6 carbon atoms; and p is an integer from 1 to 10.

3. The process of claim 2 wherein $R^1$ is an aliphatic hydrocarbon radical having 8–18 carbon atoms.

4. The process of claim 2 wherein p is an integer between 1.2 and 1.4.

5. The process of claim 1 wherein said alkyl or alkenyl oligoglycoside paste is based on $C_{8/10}$ and $C_{12/14}$ coconut oil fatty alcohol.

6. The process of claim 1 wherein said alkyl or alkenyl oligoglycoside paste has a water content of 20 to 80% by weight, based on the weight of said paste.

7. The process of claim 6 wherein said alkyl or alkenyl oligoglycoside paste has a water content of 30 to 50% by weight, based on the weight of said paste.

8. The process of claim 1 wherein said anionic surfactant is selected from the group consisting of soaps, alkyl benzenesulfonates, olefin sulfonates, alkane sulfonates, alkylether sulfonates, alpha-sulfofatty acids, internal sulfofatty acids, alpha-ester sulfonates, glycerol ether sulfonates, alkyl sulfates, alkylether sulfates, glycerol ether sulfates, monoglyceride ether sulfates, hydroxy mixed ether sulfates, alkyl oligoglucoside sulfates, isethionates, taurides, sarcosinates, ether carboxylic acids, sulfo-succinates, sulfotriglycerides, alkyl ether phosphates, and mixtures thereof.

9. The process of claim 1 wherein said nonionic surfactant is selected from the group consisting of fatty alcohol polyglycol ethers, alkylphenol polyglycol ethers, mixed ethers, amine oxides, sugar esters, sorbitan esters, polysorbates, and mixtures thereof.

10. The process of claim 1 wherein said detergent component is selected from the group consisting of alkali metal and alkaline earth metal phosphates and phosphonates, zeolites, nitrilotriacetic acid, ethylenediaminetetraacetic acid, citric acid, polycarboxylic acids, alkali metal and alkaline earth metal carbonates, sulfates, silicates, borates, citrates, starch, sucrose, polydextrose, active oxygen carriers, bleach activators, optical brighteners, foam inhibitors, and mixtures thereof.

11. The process of claim 1 wherein step (d) is conducted in the presence of air.

12. The process of claim 1 wherein step (d) is conducted in the presence of an inert gas.

13. The process of claim 1 wherein step (d) is conducted in the presence of superheated steam.

* * * * *